US005963991A

United States Patent [19]

Agosti et al.

[11] Patent Number: 5,963,991

[45] Date of Patent: Oct. 12, 1999

[54] AUTOMATIC AND SELF-CLEANING HYGIENIC-SANITARY SYSTEM FOR PUBLIC USE

[76] Inventors: Roberto Agosti, Corso Europa, 48, 17025 Loano (Savona); Domenico Mantegazza, Via Montello, 38/3, 20060 Gessate (Milano); Gioachino Albano, Viale Regina Giovanna, 38, 20129 Milano, all of Italy

[21] Appl. No.: 09/010,277

[22] Filed: Jan. 21, 1998

[30] Foreign Application Priority Data

Jan. 22, 1997 [IT] Italy ..... MI97A0117

[51] Int. Cl.[6] ..... E03D 9/08; A47K 13/24

[52] U.S. Cl. ..... 4/233; 4/662

[58] Field of Search ..... 4/662, 233, 661, 4/222, 223

[56] References Cited

U.S. PATENT DOCUMENTS

| | | | |
|---|---|---|---|
| 2,563,095 | 8/1951 | Beyrodt | 4/233 |
| 2,592,167 | 4/1952 | Monaghan | 4/233 |
| 2,605,478 | 8/1952 | Lassiter | 4/662 |
| 4,233,692 | 11/1980 | Sinsley | 4/662 |
| 4,692,951 | 9/1987 | Taki et al. | 4/662 |
| 4,745,639 | 5/1988 | Wileman, III | 4/662 |

FOREIGN PATENT DOCUMENTS

| | | | |
|---|---|---|---|
| 274588 | 7/1988 | European Pat. Off. | 4/662 |
| 274785 | 7/1988 | European Pat. Off. | 4/662 |
| 2907754 | 9/1980 | Germany | 4/233 |
| 5-247989 | 9/1993 | Japan | 4/233 |
| 93/13703 | 7/1993 | WIPO | 4/233 |

*Primary Examiner*—Charles R. Eloshway
*Attorney, Agent, or Firm*—Bucknam and Archer

[57] ABSTRACT

An automatic and self-cleaning hygienic-sanitary system for public use, having a hygienic bowl, cleaning device for cleaning to a sanitary condition the hygienic bowl, and a protecting device for protecting the cleaning device of the hygienic bowl against tampering. A floor cleaning and sanitating device for cleaning the floor supporting the hygienic bowl is moreover provided.

21 Claims, 3 Drawing Sheets

AUTOMATIC AND SELF-CLEANING HYGIENIC-SANITARY SYSTEM FOR PUBLIC USE

BACKGROUND OF THE INVENTION

The present invention relates to a self-cleaning hygienic-sanitary system for public use.

As is known, conventional public use hygienic-sanitary systems usually comprise automatic cleaning devices for cleaning the hygienic bowl.

A prior such cleaning device comprises a washing and drying cabinet arranged on the rear of and above the ceramics material bowl. This cleaning device comprises two plates mounted on an articulated support, which alternatively drives the plates to an operating position and a washing and drying position within the cabinet.

For replacing said plates in the above mentioned cleaning device, it is necessary to open and close a partition element, remove the used plate and locate to a set position a cleaned plate.

Accordingly, this device requires a very complex operating mechanism, which is very expensive construction-wise and, moreover, easily susceptible to failures.

The operation of this prior device is merely limited to a washing of the seating plate, without cleaning the affected portions of the hygienic bowl and floor upon which the bowl is installed.

Moreover, the device can be easily tampered by ill intentioned persons.

Another prior cleaning system comprises an annular plate or seating plank, which can turn through 360° about the rotary axis thereof, so as to cause its surface to be displaced under a radially extending washing and drying device arranged on the rear of the bowl and seating plank or plate. The hygienic bowl, in particular, is washed by using a conventional water tank.

This second device, in addition to having a rather complex configuration, presents moreover the drawback of a very slow operation.

In fact, the radial device does not allow to simultaneously clean all the seating plate or plank, but only a small portion thereof.

In order to provide a satisfactory washing and drying operation, the rotary speed of the seating plate or plank must be very low and, accordingly, it will require a comparatively long time between two subsequent uses. Moreover, the rotary system prevents the seating plate from being tilted and it, being subjected to a comparatively high stress, will be quickly put out of service because of frequent failures.

In addition, this type of device is not designed for washing all of the parts of the hygienic bowl.

This prior system can be easily tampered by ill-intentioned persons.

SUMMARY OF THE INVENTION

Accordingly, the aim of the present invention is to overcome the above mentioned problems, by providing a self-cleaning and automatic hygienic-sanitary system for public use, which provides a quick, reliable, anti-tampering washing and sanitating both of the hygienic bowl and of the floor upon which the hygienic bowl is supported.

Within the scope of the above mentioned aim, a main object of the present invention is to provide such a self-cleaning hygienic-sanitary system which is adapted to automatically operate and which is very reliable and safe in operation.

Another object of the present invention is to provide such a self-cleaning hygienic-sanitary system which can be made at a competitive cost.

According to one aspect of the present invention, the above mentioned aim and objects, as well as yet other objects, which will become more apparent hereinafter, are achieved by a self-cleaning hygienic-sanitary system for public use, characterized in that said system comprises a hygienic bowl, cleaning and sanitating means for cleaning and sanitating said hygienic bowl, and protecting means for protecting said cleaning and sanitating means of said hygienic bowl against tampering, floor cleaning and sanitating means for cleaning and sanitating a floor upon which said hygienic bowl is supported being moreover provided.

BRIEF DESCRIPTION OF THE DRAWINGS

Further characteristics and advantages of the automatic hygienic-sanitary system according to the present invention will become more apparent from the following detailed disclosure of a preferred, though not exclusive, embodiment of said system, which is illustrated, by way of an indicative, but not limitative example, in the accompanying drawings, where.

DESCRIPTION OF THE PREFERRED EMBODIMENTS

Figure 1:
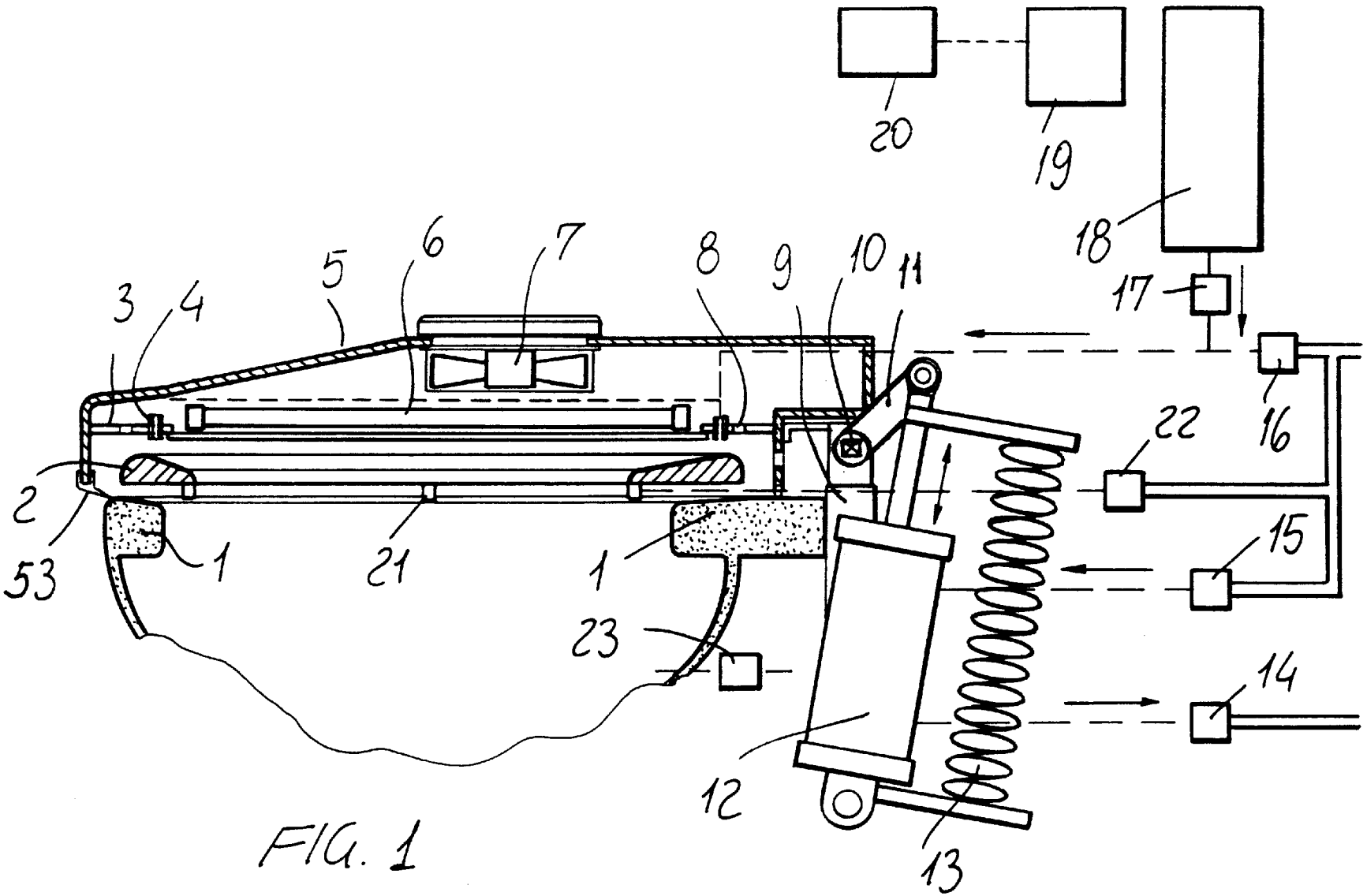
FIG. 1 is a vertical cross-sectional view illustrating the hygienic bowl and cleaning and sanitating means associated therewith.
Figure 2:
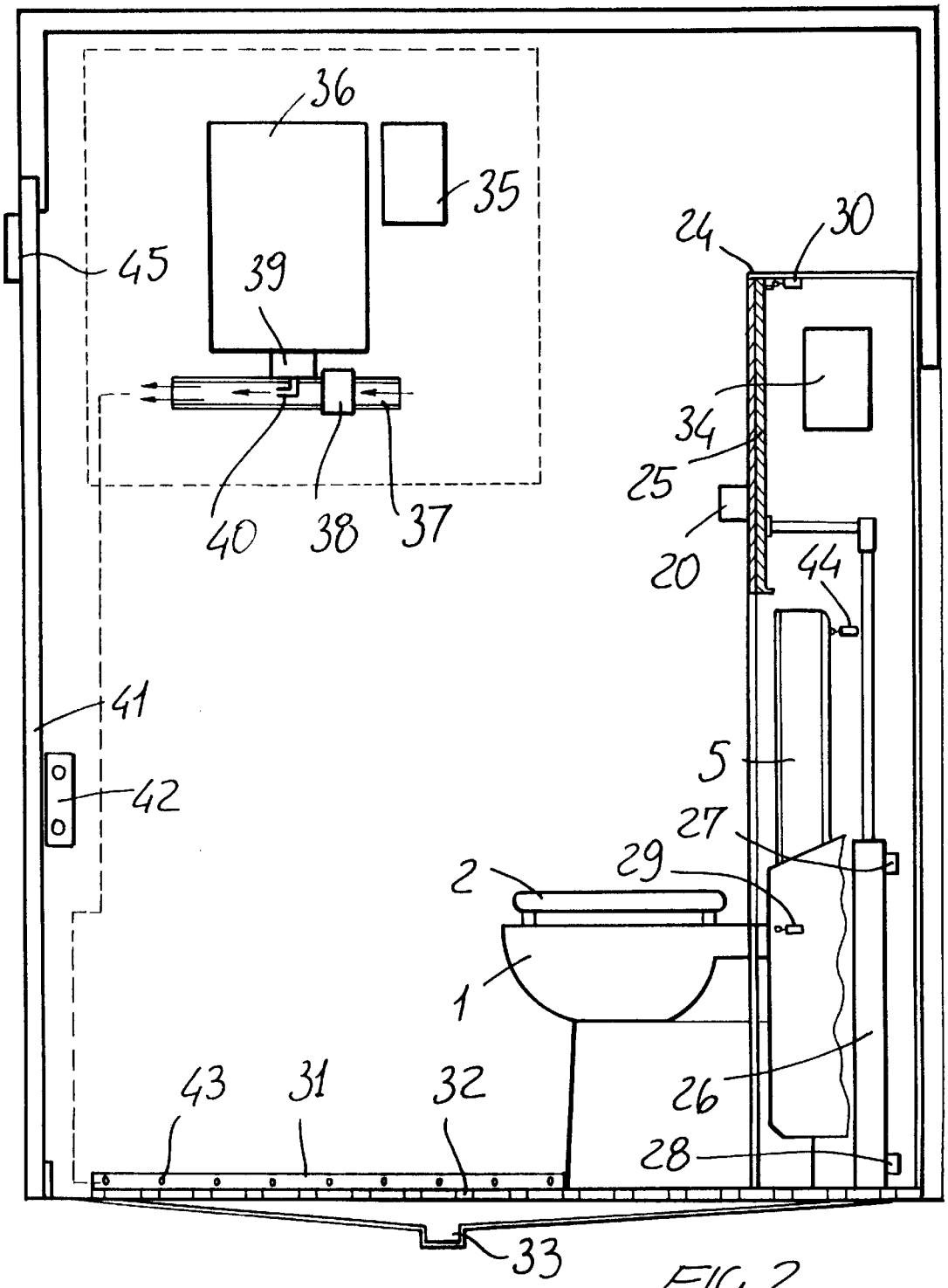
FIG. 2 is a vertical cross-.sectional view illustrating the self-cleaning hygienic-sanitary System according to the present invention as seen from a side.
Figure 3:
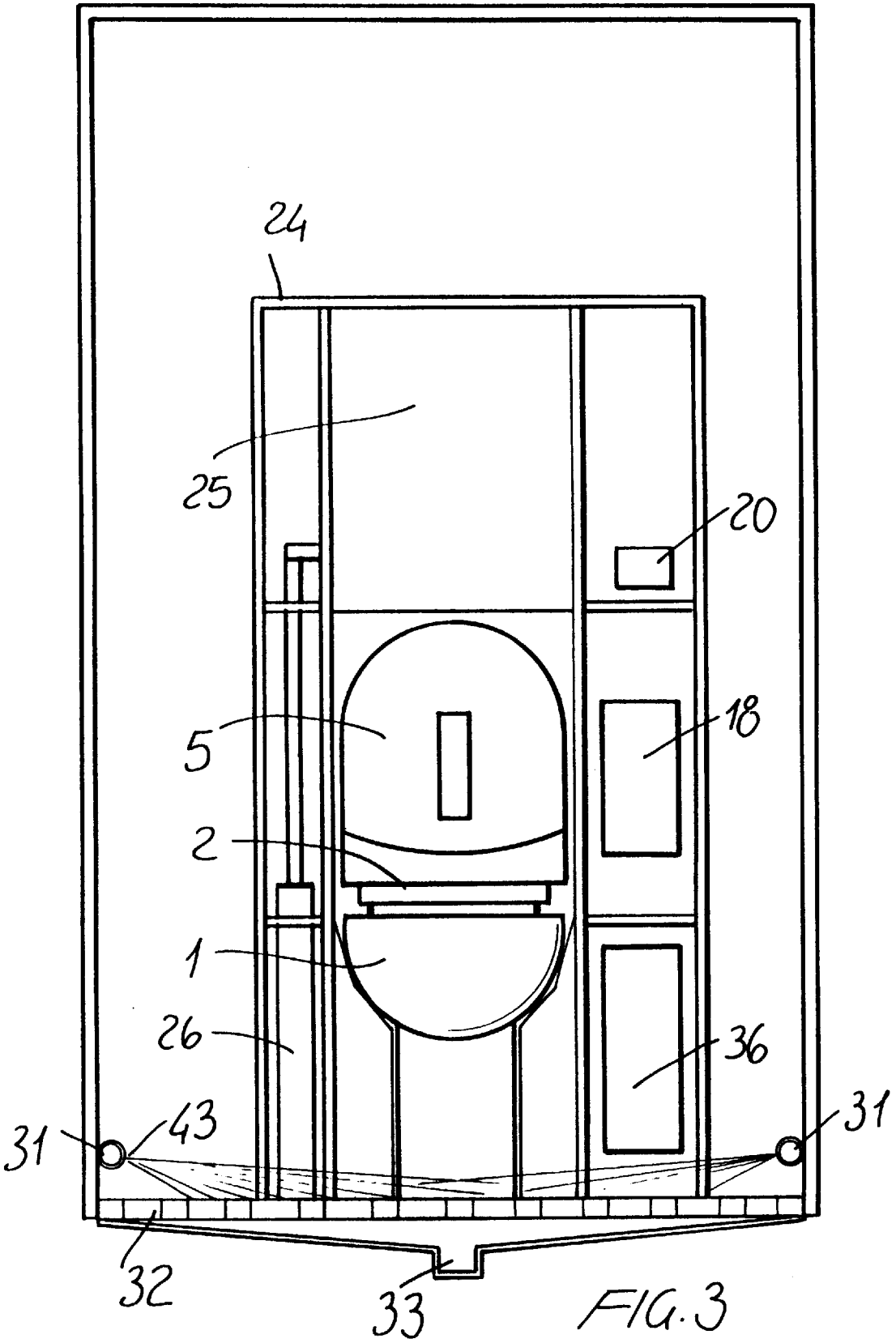
FIG. 3 is a further vertical cross-sectional view illustrating the self-cleaning hygienic-sanitary system according to the present invention, as seen from the front thereof.

With reference to the number references of the above mentioned figures, the self-cleaning hygienic sanitary system according to the present invention comprises a ceramics bowl, provided with a top edge 1 upon which a plate or seating plank or board 2 is arranged.

The plate 2 has a cross-section which is slanted toward the inside of the hygienic or toilet bowl.

The subject hygienic-sanitary system comprises moreover cleaning and sanitating means for cleaning and sanitating the hygienic bowl as well as protecting means for protecting said hygienic bowl cleaning and sanitating means from tampering.

More specifically, said hygienic bowl cleaning and sanitating means comprise a housing 5, having a cover-like configuration and concave on the side thereof provided for facing the edge 1 of the hygienic bowl. The housing 5 is pivoted on the rear edge of the hygienic bowl, about a horizontal pivot axis 10, so as to assume a substantially vertical raised position and a horizontal lowered position, in which it will fully cover the top edge 1 of the hygienic bowl.

The housing or carter 5 comprises a plurality of nozzles 4 connected to one another by a water circuit and adapted to deliver a washing and disinfection mixture on the surface of the plate 2 and on the top edge 1 of the hygienic bowl. The housing or carter 5 is moreover provided with drying means for drying said plate 2 and hygienic bowl, as well as with electromagnet wave UV generating means.

The rotary movement of the carter or cover 5 for allowing it to pass from its raised position to its lowered position in which it will be lowered or abutted on the top edge 1 of the hygienic bowl, can be obtained, as shown, by a hydraulic cylinder 12 which has a cylinder body coupled to a fixed construction and the piston rod of which drives a connecting rod 11.

Said connecting rod 11, in turn, is coupled to a shaft defining an axis 10 rigid with said carter or cover 5.

The cylinder 12 can be of a hydraulic type and it can be supplied by a pressurized hydraulic circuit, controlled through control valves 14 and 15.

As the hydraulic cylinder 12 is operated, the carter or cover 5 will be displaced from the lowered position to the raised position thereof, against the biassing force of a return spring 13.

The carter or cover 5 is moreover provided, at its bottom perimetrical edge, with a gasket 53, made of a soft material, thereby, as the carter or cover 5 is lowered, said gasket will engage by the overall perimeter thereof with the top edge 1 of the hygienic bowl.

The nozzles 4 are connected to one another by a hydraulic circuit and, with the carter or cover 5 in its lowered position, said nozzles will be arranged above the plate 2 in a horizontal plane, downwardly directed, so as to direct their jets on the plate 2 on the ceramic edge 1. The nozzles 4 have been specifically designed to spray a cleaning/sanitating mixture on the plate 2 and edge 1.

Both said plate 2 and edge 1 have a cross-section which is slanted toward the inside of the hygienic bowl and, because of this arrangement, the sprayed cleaning/sanitating mixture will be directed to the inside of the hygienic bowl, thereby sanitating the walls and siphon thereof.

The cleaning-sanitating liquid sprayed by said nozzles 4 is delivered from a tank 18, and the delivery thereof, as well as the mixing thereof with water are controlled or adjusted by control valves 16 and 17.

The plate 2 can be turned about an axis (not shown) parallel to the axis 10 of the carter or cover 5 and can be raised as the seating plate or plank of a conventional hygienic bowl. The outer diameter of the plate 2, in particular, is slightly smaller than that of the edge 1, thereby allowing the gasket 53 of the carter or cover 5 to engage with the top edge 1 of the hygienic bowl, to hold in its inside also the plate 2.

Under the plate 2 further nozzles 21 are assembled, said nozzles 21 being connected to one another by a hydraulic circuit and being arranged in a horizontal plane and downward directed, so as to eject their pressurized water jets on the inner surface of the hygienic bowl.

The water supply to said nozzles 21 is controlled by a control valve 22.

A further valve 23 controls the water flow necessary for the flushing system of the hygienic bowl.

The drying means for drying the hygienic bowl and plate 2 comprise a drying fan 7, arranged on the face of the carter 5 provided for facing the hygienic bowl.

As the fan 7 is driven, it will generate an air flow to the inside.

Said fan is preferably arranged near the central part of the carter 5 and being associated with a diffusion partition member 3 which, through orifices 8, will direct the air flow toward the plate 2.

Alternatively, the plate drying system can also comprise other known drying means, technically equivalent to the illustrated drying means.

The electromagnetic wave UV generating means comprise a UV lamp or bulb 6, which is associated with the carter 5 and which, more specifically, is arranged on the diffuser 3, so as to irradiate the plate 2, the edge 1 of the hygienic bowl and the inside of said hygienic bowl.

Said lamp 6, by emitting UV electromagnetic waves, will sanitate the parts irradiated thereby.

The operation of the hygienic bowl cleaning and sanitating means is controlled by a first electronic central unit 19, which is coupled to an optical sensor 20 so arranged as to detect the presence of a user.

The protecting means for protecting the hygienic bowl cleaning and sanitating means from tampering or from vandalic actions comprise a cabinet 24 holding therein the carter 5 as the latter is arranged in its vertical raised condition.

The cabinet 24 is provided with a guillotine type of partition element 25 which can be raised and lowered by a hydraulic cylinder 26. The operating stroke of the hydraulic cylinder 26 and, accordingly, of the guillotine 25 connected to said hydraulic cylinder, will be controlled by sensors 29 and 30.

The guillotine partition member 25 is so arranged and designed that, as it is in a lowered position, only the table 2 and hygienic bowl can be accessed by the user, whereas the carter 5 and elements coupled to said carter 5 can not be accessed.

The protecting means comprise moreover a second electronic central unit 34, possibly interfaced with said first electronic central unit 19 and a third electronic central unit 35 controlling floor cleaning and sanitating means for cleaning and sanitating the floor on which said hygienic bowl is supported, as it will become more apparent hereinafter.

The floor cleaning and sanitating means comprise a slitted floor 32 which is arranged above the floor of the system proper, and being provided with a recessed draining region 33.

Immediately above the slitted floor 32 a plurality of nozzles 43 supplied by a hydraulic circuit 31 are arranged.

The operation of the nozzles 43 is controlled by the third electronic central unit 35 which is coupled to an electric lock 42 arranged on the access door 41 allowing the subject hygienic-sanitary system to be accessed.

The third electronic central unit 35 is also connected to a light signalling device 45 and to a water/cleaning agent mixing system.

The above mentioned water/cleaning agent mixing system comprises a tank 36, into which a cleaning agent or liquid will be arranged, and which tank, through a valve 39, is coupled to a water delivery duct 37. Along the water delivery duct 37 a further shut-off valve 38 is arranged, said valve 39 coupling the tank 36 to a pipette 40 arranged inside the duct 37.

The self-cleaning hygienic-sanitary system according to the present invention operates as follows.

As the user access the hygienic bowl, this is sensed by the user presence sensor 20 which will transmit this information to the first electronic central unit 19. The latter will cause the piston of the cylinder 12 to be withdrawn, thereby the carter 5 will be turned upward about the rotary axis 10, to achieve a substantially vertical position.

The seating plate 2 is now arranged at a lowered position and the user can seat thereon.

At the end of the use, the user will move away, which will be detected by the user presence sensor 20 which will transmit the related information to the first electronic central unit 19.

The latter will drive the cylinder 12 to a draining operation, and the piston of said cylinder 12 will be extended by the spring 13, to cause the carter 5 to assume its horizontal lowered position. As the carter or cover 5 has assumed a closed condition on the hygienic bowl, the valves 22 and 23 will be simultaneously opened, thereby the overall hygienic bowl will be perfectly washed by the pressurized water jets ejected by the nozzles 21 and evacuated by the flushing system.

Then, and for a preset time, the valve 16 will be driven to open, so as to wash by pressurized water jets the plate 2 and the edge 1, by the nozzles 4.

Then, the valve 16 will be closed, whereas the valve 17 will be opened for a preset time, to allow the cleaning/sanitating product held in the tank 18 to fill the hydraulic circuit connecting the nozzles 4.

Then, the valve 17 will be closed, and the valve 16 will be opened for a preset time, to provide a water/cleaning liquid mixture to project it on the table 2 and edge 1 through the nozzles 4.

Thus, the cleaning/sanitating product will also affect the inner walls and the siphon of the hygienic bowl.

Then, the valve 16 will be closed and the fan 7 and UV lamp 6 will be actuated for a preset time. Thus, the table 2 will be dried and sanitated, and the air ejected from the fan 7 will be also sanitated as well as all of the other surfaces affected by the UV radiations.

The hygienic bowl will be accordingly ready for a further use and the plate 2, the edge 1 and inner surfaces of said hygienic bowl will be washed and sanitated in a quick and efficient manner.

As the carter 5 is lowered and arranged in its horizontal position, the guillotine partition element 25 will be arranged in a raised position. As the sensor 20 detects the presence of the user, it will send a presence signal to the first electronic central unit 19, which will cause the carter 5 to turn to its vertical position. In this position, the sensor 44 will be actuated, which will send a corresponding signal to the electronic central unit 34 driving or controlling through the valves 27 and 28 the hydraulic cylinder 26. Then the cylinder will re-enter or withdraw, thereby causing the guillotine partition element 25 to lower.

At this time, the hygienic bowl and plate 2 can be accessed by the user, whereas the carter 5 can not be accessed, and, accordingly, it can not be tampered or affected by vandalic actions.

At the end of the use, the sensor 20 will detect such an event and, through the electronic central unit 34 and cylinder 26 will cause the guillotine element 25 to raise, and will actuate the means for cleaning and sanitating the hygienic bowl, as disclosed.

The electronic central unit 35, interfaced with the electronic central unit 34, is provided with a cycle counter, designed for storing the number of cyclic operations of the hygienic bowl cleaning and sanitating means as well as of the anti-tampering device. Actually, said counter will store the number of users and it will be programmed to control a working cycle, after having stored a set number of users.

As the preset user number has been achieved, and the sensor 20 does not detect the presence of an user, the electronic central unit 35 will cause the lock 42 applied to the door 41 to close and will actuate a corresponding closing light signal 45.

At this time, the valve 38 arranged on the pressurized water circuit 37 will be driven for a set time.

The pressurized water will be sprayed by the nozzles 43 of the pipes 31 on the overall surface of the slitted or grilled floor 32.

The excess water will be drained from the draining region 33 to the draining system.

Then, for a set time, the valve 39 will be controlled to open, thereby allowing the cleaning/sanitating product held in the tank 36 to be mixed with the water delivered through the pipette 40.

Then, the valve 38 and 39 will be closed, the lock 42 opened and the light signal 45 deactuated.

Thus, the floor is also perfectly washed and disinfected, during which operation no user will be present.

From the above disclosure and from the figures of the accompanying drawings, it should be apparent that the invention fully achieves the intended aim and objects.

In particular, the fact is to be pointed out that a self-cleaning hygienic-sanitary system for public use has been provided, which is very reliable and safe in operation, thereby providing a perfect cleaning and sanitating of the hygienic bowl as well as of the floor supporting it.

While the electronic central units have been disclosed in an interfacing relationship in order to exchange mutual information, said electronic central units can be also independent from one another and they can use dedicated sensors, depending on requirements.

While the invention has been disclosed and illustrated with reference to preferred embodiments thereof, it should be apparent that the disclosed embodiments are susceptible to many modifications and variations, all of which will come within the scope of the appended claims.

We claim:

1. A self-lea hygienic-sanitary system for public use, comprising:

a hygienic bowl with an inside and a plate forming a seat connected to said hygienic bowl;

a cleaning and sanitating device for cleaning and sanitating said hygienic bowl and said plate by injecting a washing and disinfecting mixture at said plate and at a top edge of said hygienic bowl;

a dryer for generating an air flow directed at said hygienic bowl and at said plate for drying said hygienic bowl and said plate after said top edge of said hygienic bowl and said plate have been subjected to injection of said washing and disinfecting mixture, and said drying means being adapted for further directing said air flow towards said inside of said hygienic bowl; and a UV device for irradiating said plate and said top edge of said hygienic bowl and said inside hygienic bowl with UV radiation simultaneously operable with said dryer so as to sanitate said top edge of said hygienic bowl and said inside of said hygienic bowl and said air flow generated by said dryer directed at said hygienic bowl and at said plate and towards said inside of said hygienic bowl.

2. A hygienic-sanitary system, according to claim 1, wherein said cleaning and sanitating comprises a carter pivoted on a rear edge of said hygienic bowl and controllably movable from a vertical raised position to a horizontal lowered position in which said carter covers the top edge of said hygienic bowl and said plate, said carter being provided with a plurality of nozzles coupled to one another by a hydraulic circuit and arranged for spraying said washing and disinfecting mixture on said plate and on said top edge of said hygienic bowl when said carter is positioned in said lowered position, said carter having said dryer attached hereto for drying said plate and said top edge of said hygienic bowl when said carter is positioned in said lowered position, and said carter having said UV device attached thereto for irradiating said plate and said top edge of said hygienic bowl and said air flow when said carter is positioned in said lowered position.

3. A hygienic-sanitary system, according to claim 2, wherein said dryer comprises a fan coupled to a diffuser, which is in turn coupled to said carter and provided with a plurality of orifices.

4. A hygienic-sanitary system, according to claim 2, wherein said UV device comprises a gas discharge lamp coupled to a face of said carter facing said hygienic bowl.

5. A hygienic-sanitary system according to claim 4, further comprising a driving motor for driving said carter between said raised position and said lowered position in which said carter abuts on the top edge of said hygienic bowl, and nozzles coupled to said plate for washing the inside of said hygienic bowl.

6. A hygienic-sanitary system, according to claim 5, further comprising a first electronic central unit programmed for controlling in succession:

operation of the motor for raising and lowering said carter;

an opening and closing of a valve for actuating a flushing system of said hygienic bowl;

an opening and closing of a supply valve supplying said nozzles coupled to said plate for washing the inside of said hygienic bowl;

an opening and closing of flyer valves for supplying said plurality of nozzles coupled to said carter for washing and sanitating said top edge of said hygienic bowl and said plate; and operation of said dryer for drying the plate and operation of said lamp for disinfecting all of the parts affected by the radiation from said lamp.

7. A hygienic-sanitary system according to claim 6, wherein said fist electronic central unit comprises a presence sensor for detecting a presence of a user and being programmed for causing said cleaning and sanitating device to start to operate immediately after a use of said hygienic bowl by said user.

8. A hygienic-sanitary system, according to claim 2, wherein the top edge of said hygienic bowl is inward slanted towards an inside of said hygienic bowl and has an outer diameter slightly greater than that of said plate, thereby said washing and disinfecting mixture ejected on the top edge of said hygienic bowl by said plurality of nozzles is deflected to the inside of said hygienic bowl.

9. A hygienic-sanitary system, according to claim 8, wherein said plate has a cross-section slanted to the inside of said hygienic bowl for conveying the washing and disinfecting mixture sprayed by said plurality of nozzle to cause said mixture to be deflected toward the inside of said hygienic bowl.

10. A hygienic-sanitary system, according to claim 9, wherein said plurality of nozzles coupled to said carter are coupled to one another by a hydraulic circuit, said hydraulic circuit being in turn coupled to a supply circuit coming from a tank for holding said washing and disinfecting mixture.

11. A hygienic-sanitary system, according to claim 1, further comprising a floor cleaning and sanitating device for cleaning and sanitating a slitted floor upon which said hygienic bowl is sorted said floor cleaning and sanitating device comprising: a draining region formed in an underlaying floor which is positioned below said slitted floor; a pipe provided with nozzles for washing said slitted floor and joined to a water supplying circuit; a cleaning and sanitating liquid tank connected to said water supplying circuit for supplying a floor cleaning and sanitating liquid to said nozzles of said pipe for washing said slitted floor; and a door provided with an electric lock and a closure light signal.

12. A hygienic-sanitary system, according to claim 11, wherein said floor cleaning and sanitating device further comprises an electronic control device programmed to successively control; the closure of said electric lock of said door the actuation of said closure light signal the opening of a valve for supplying said nozzles of said pipe with water: the opening and closing of a valve for supplying into the pipe for supplying said nozzles said cleaning and sanitating liquid held in a tank; the closing of the valve for supplying said nozzles of said pipe with water; the opening of said electric lock, and the deactuating of the closure light signal.

13. A self-cleaning hygienic-sanitary system, comprising:

a hygienic bowl;

a cleaning and sanitating device carried by a carter movably connected to said hygienic bowl between a lowered position for cleaning and sanitating said hygienic bowl and a raised position for use of said hygienic bowl; and a protecting device for protecting said clean and sanitating device of said hygienic bowl against tampering;

said protecting device comprising a cabinet for holding therein the cleaning and sanitating device and the carter positioned in said raised position, said cabinet being provided with a guillotine partition element for hygienic opening and closing an aperture through said cabinet, said aperture being adapted to allow said carter to pass therethrough when said carter is moved between said raised and lowered positions, and said system further comprising a motor driving said guillotine partition element, and an electronic control device for controlling the selective opening and closing of said aperture by said guillotine partition element of said protecting device.

14. A hygienic-sanitary system, according to claim 13, further comprising an electronic control device for operating said cleaning and sanitating device according to a presence of a user and a use of said hygienic bowl by the user, said electronic control device for operating said cleaning and sanitating device being interfaced with said electronic control device for controlling the selective opening and closing of said aperture by said guillotine partition element so that the selective opening and closing of said aperture by said guillotine partition element is also performed according to the presence of the user and the use of said hygienic bowl by the user.

15. A hygienic-sanitary system, according to claim 14, further comprising a floor cleaning and sanitating device for cleaning and sanitating a floor upon which said hygienic bowl is supported;

said floor cleaning and sanitating device comprising: an electronic control device programmed to successively control a floor cleaning and sanitating cycle successively comprising: a closure of an electric lock of a door of the hygienic-sanitary system; an actuation of a closure light signal of said door; a supplying of floor washing nozzles with a cleaning and sanitating liquid for washing said floor; a closing of the supply of said floor washing nozzles with said cleaning and sanitating liquid after said floor has been washed; an opening of said electric lock; and a deactuating of the closure light signal; and said electronic control device of said floor cleaning sanitating device being provided with a cycle counter for counting the number of uses of said hygienic bowl for actuating the operation of the floor cleaning and sanitating cycle.

16. A hygienic-sanitary system, according to claim 15, wherein said electronic control device of said floor cleaning and sanitating device is interfaced and operated together with said electronic control device for operating said cleaning and sanitating device and with said electronic control device for controlling the selective opening ad closing of said aperture by said guillotine partition element.

17. A hygienic-sanitary system, according to claim 15, wherein said electronic control device of said floor cleaning and sanitating device is operated independently from said electronic control device for operating said cleaning and sanitating device and said electronic control device for controlling the selective opening and closing of said aperture by said guillotine partition element.

18. A hygienic-sanitary system, according to claim 13, wherein said electronic control device for controlling the selective opening and closing of said aperture is programmed in order to successively control the opening and closing of valves controlling the operation of said motor in the form of a hydraulic motor for driving said guillotine partition element.

19. A self-cleaning hygienic-sanitary system, comprising:

a hygienic bowl;

a cleaning and sanitating device for cleaning and sanitating said hygienic bowl;

a cleaning and sanitating device for cleaning and sanitating said hygienic bowl; and a floor cleaning and sanitating device for cleaning and sanitating a floor upon which said hygienic bowl is supported;

said floor cleaning aid sanitating device comprising: an electronic control device programmed to successively control a floor cleaning and sanitating cycle successively comprising: a closure of an electric lock of a door of the hygienic-sanitary system; an actuation of a closure light signal of said door; a supplying of floor washing nozzles with a cleaning and sanitating liquid for washing said floor; a closing of the supply of said floor washing nozzles with said cleaning and sanitating liquid after said floor has been washed; an opening of said electric lock; and a deactuating of the closure light signal; and said electronic control device being provided with a cycle counter for counting the number of uses of said hygienic bowl for actuating the operation of the floor cleaning and sanitating cycle.

20. A hygienic-sanitary system, according to claim 19, wherein a supply circuit for said floor washing nozzles is provided with a pipette coupled to a tank for containing said cleaning and sanitating liquid through a valve which is controlled by said electronic control device for mixing said cleaning and sanitating liquid from said tank with water supplied to the floor washing nozzles through said supply circuit.

21. A hygienic-sanitary system, according to claim 20, wherein a pipe of said supply circuit comprises a plurality of said floor washing nozzles arranged fully wash and sanitate said floor.

* * * * *